United States Patent [19]

Williams

[11] 4,167,048

[45] Sep. 11, 1979

[54] PORTABLE SHAMPOO SEAT ADAPTER WITH LIQUID RUN-OFF ATTACHMENT

[76] Inventor: Mary E. Williams, 3269 Tribol La., San Jose, Calif. 95122

[21] Appl. No.: 861,900

[22] Filed: Dec. 19, 1977

[51] Int. Cl.[2] ..... A47K 3/12

[52] U.S. Cl. ..... 4/159

[58] Field of Search ..... 4/159, 185 B, 185 HB, 4/185 R, 185 S; 297/250, 410

[56] References Cited

U.S. PATENT DOCUMENTS

| | | | |
|---|---|---|---|
| 2,013,823 | 9/1935 | Chancer | 4/159 |
| 2,351,849 | 6/1944 | Wells et al. | 4/159 |
| 2,493,806 | 1/1950 | Dumas | 297/250 |
| 2,516,601 | 7/1950 | Smalls | 4/159 |
| 2,527,868 | 10/1950 | Wilson | 297/410 |

*Primary Examiner*—Richard E. Aegerter
*Assistant Examiner*—L. Footland
*Attorney, Agent, or Firm*—Jack M. Wiseman

[57] ABSTRACT

A portable shampoo seat adapter for children that is disposed on the seat of a conventional barber or beautician chair with the back thereof adjacent to and below a conventional shampoo wash bowl. A headrest on the back rest of the seat adapter is disposed in front of and above the shampoo wash bowl on which rests the neck of a child. A water run-off guide extends from the neck rest and has a configuration to surround the neck of the child and to provide a path over which water dripping from the child's hair is returned to the shampoo wash bowl.

3 Claims, 5 Drawing Figures

Fig-1
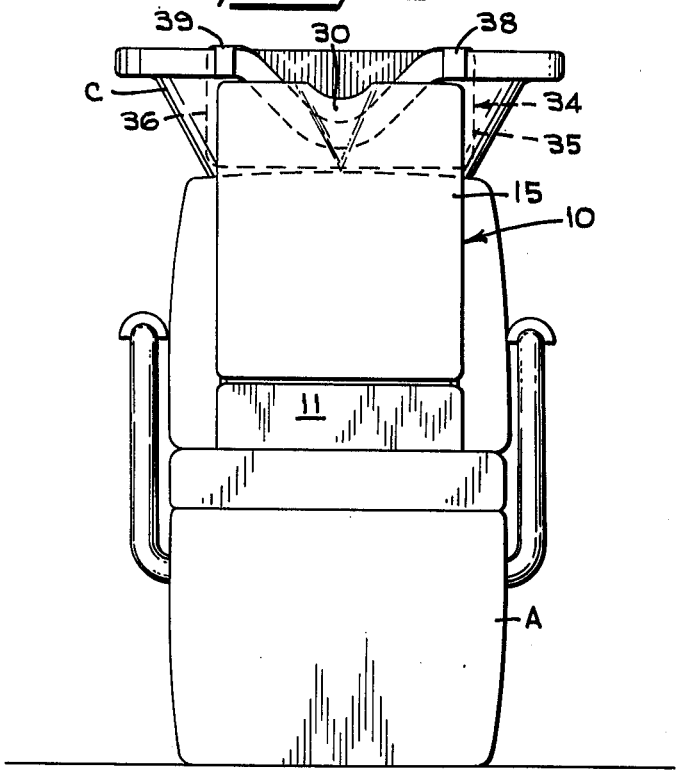
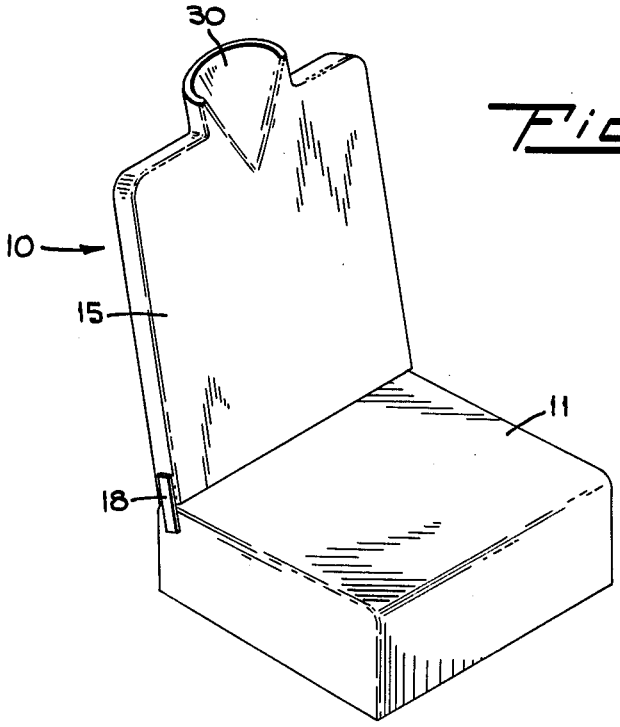
Fig-2

Fig-3
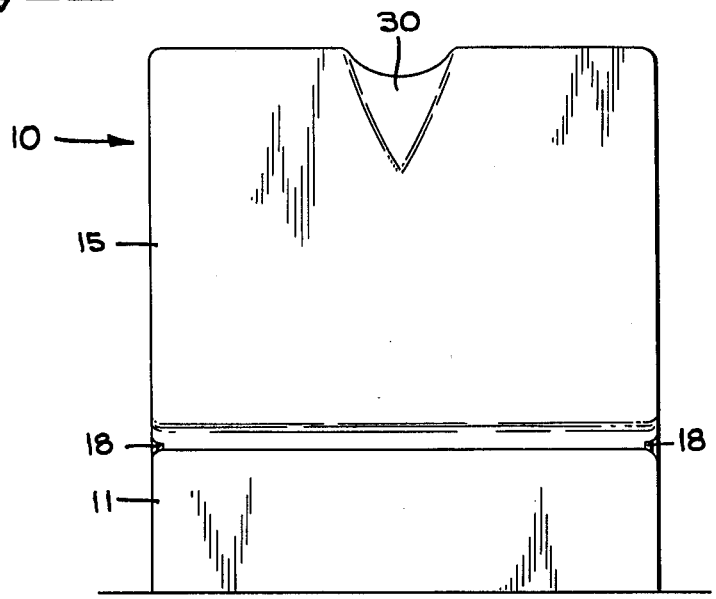
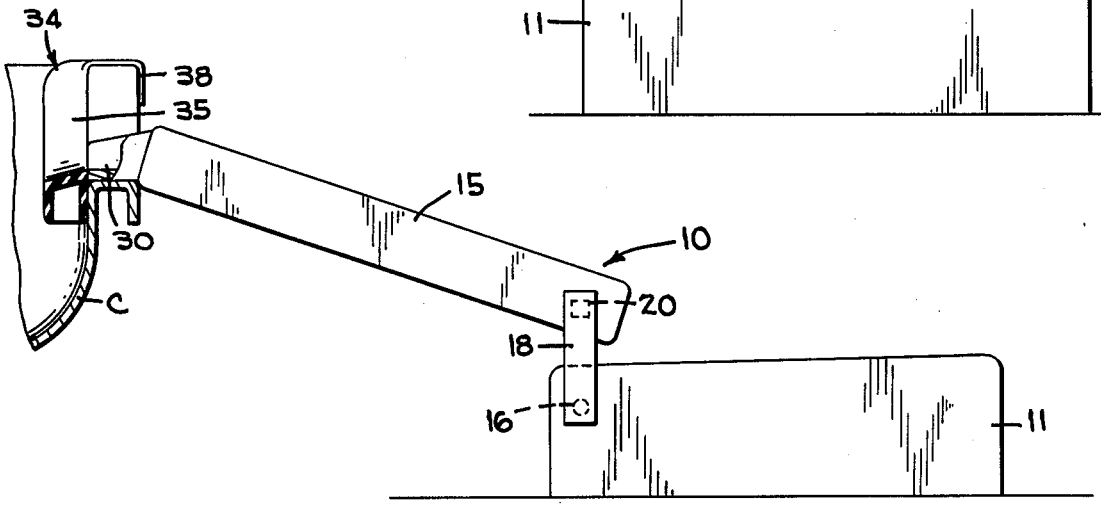
Fig-4
Fig-5
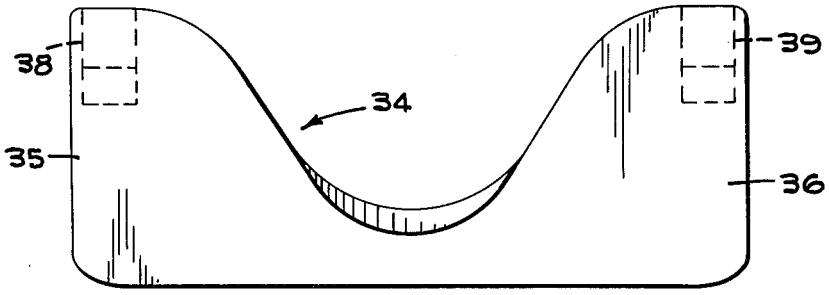

PORTABLE SHAMPOO SEAT ADAPTER WITH LIQUID RUN-OFF ATTACHMENT

BACKGROUND OF THE INVENTION

The present invention relates in general to barber and beautician chairs, and more particularly to a portable seat adapter disposed on the seat of a barber or beautician chair.

Heretofore, portable auxiliary seats have been provided for automobiles in which the back rest is pivotally attached to the seat thereof. Such disclosures are made in the patent to Dumas U.S. Pat. No. 2,493,806, for Portable Auxiliary Seat For Automobiles, and the patent to Sandor No. 3,378,299, for Automobile Seating Construction. Similar portable auxiliary seats have also been disclosed in the patent to Champion No. 3,346,298 and the patent to Schick et al. No. 3,112,956.

In the patent to Wilson No. 2,527,868 for Headrest For Hair Dryers, there is disclosed a beautician chair having a back rest. On the back rest is a depression to accommodate a person's neck. Secured to the back rest at the depression is a head rest. Behind the head rest is located a drier. The patent to Hedstrom U.S. Pat. No. 926,531 shows a chair in front of a wash bowl. The back rest of the chair is pivotally attached to the seat of the chair. At the top of the back rest is mounted a head rest. The head rest is centrally depressed to form a convenient rest for the back of a person's head. As for the patent to Onsa No. 2,463,049, there is disclosed a shampoo chair for children. The back of the chair includes a head rest disposed in a recess formed in the back of the chair. In the patent to Ellinger No. 2,315,153 is disclosed a hair washing sink. Integrally formed with the sink is a seat having a back rest. On the top of the back rest is a recessed head rest.

A shampoo drain for a barber chair is disclosed in the patent to Cannady U.S. Pat. No. 1,791,348. The drain is placed at the top of the back rest for the barber chair overlying the head rest. The drain is curved to accommodate the back of the customer's neck and a spout or tube through which water from the shampoo is conducted into a wash bowl. In the patent to Espin No. 3,545,012, there is disclosed an infant's shampoo accessory which includes a head and neck rest member extending over a sink. In the patent to Wells et al. No. 2,351,849 is disclosed a shampoo pillar for an infant with a depression to rest the neck and head of the infant. The patent to Watson No. 3,449,771, discloses a portable shampoo assembly that rests on a bed. The assembly includes a neck rest having an arcuate shape to cradle the neck. A collar is formed to extend from the neck rest. A channel is provided to conduct liquid to a drain reservoir.

Heretofore, there was lacking a portable auxiliary shampoo chair for children that was adapted to be seated on a conventional barber or beautician chair in which there was provided a head rest and a drain extending from the head rest for leading water dripping from the head of the child into the wash bowl.

SUMMARY OF THE INVENTION

A portable children's auxiliary shampoo chair adapted to seat on a conventional barber or beautician chair. The auxiliary chair comprises a seat and a back rest pivotally attached to the seat. On the top of the back rest is formed a neck rest with a recessed area to accommodate the back of the neck of a child. Extending from the recessed area of the neck rest at the top of the back rest are drain guides which are disposed above a wash bowl to collect water dripping from the head of the child and to guide the dripping water into the wash bowl. The drain guides have a yoke, horseshoe, or saddle configuration that is disposed above the bowl and is constructed as an extension from the neck rest of the chair to collect dripping water and to discharge the collected water into the wash bowl.

DESCRIPTION OF THE DRAWINGS

FIG. 1 is a front elevation view of a conventional beautician chair with a conventional shampoo wash bowl behind the back rest thereof and a portable children's auxiliary shampoo chair embodying the present invention seated on the beautician chair.

FIG. 2 is a perspective view of the portable children's auxiliary shampoo chair embodying the present invention without the drain guide.

FIG. 3 is a front elevation view of the portable children's auxiliary shampoo chair shown in FIG. 2 without the drain guide.

FIG. 4 is a side elevation view of the portable children's auxiliary shampoo chair shown in FIG. 1 illustrated with a conventional shampoo wash bowl.

FIG. 5 is a plan view of the drain guide employed in the portable children's auxiliary shampoo chair shown in FIGS. 1 and 4.

Illustrated in FIG. 1 is a conventional barber or beautician chair A. Behind the back rest of the chair A is located a conventional shampoo wash bowl C. Seated on the chair A is the portable children's auxiliary shampoo chair 10 embodying the present invention.

The portable auxiliary shampoo chair 10 for children comprises a seat 11, which is disposed on the seat of the conventional barber or beautician chair A. The seat 11 includes a polyurethane plastic frame around which is located a foam rubber padding. A polyvinyl cover encloses the rubber padding.

Pivotally attached to the seat 11 is a back rest 15. Toward this end, the seat 11 includes a transversely disposed steel rod 16. At each end of the steel rod 16 is a hub, not shown, which journals the rod 16 thereon for rotation. The hub projects inwardly from a bar 18. At the opposite end of the bar 18 is a similar hub, which projects inwardly. There is a pair of such pivot assemblies, on at each end of the rod 16. Disposed transversely in the back rest 15 is a steel rod 20, which is fixed at each end to the bar 18.

The back rest 15 comprises a polyurethane plastic frame, not shown. Filled in the back rest 15 is a foam rubber padding. A polyvinyl cover encloses the foam rubber padding and the frame. The back rest 15 can be adjusted to provide a suitable angle between the seat 11 and the back rest 15. When in its adjusted position, the back rest 15 is supported by the back rest of the chair A.

Formed at the top of the back rest 15 to overlie the shampoo wash bowl C is a neck rest 30. The neck rest 30 has substantially a semi-cylindrical configuration to accommodate the back of the neck of a child. Mounted on the inner wall of the wash bowl C and in alignment with the neck rest 30 is a shampoo run-off attachment 34 formed with oppositely directed wing-like drain guides 35 and 36, which form a path to drain liquid dripping from the child's head into the drain bowl C. The neck rest 30 and the drain guides 35 and 36 together have a horse-collar, yoke-like or saddle-like configuration. The drain guides 35 and 36 are made of suitable rubber to collect water dripping from the neck of the child to discharge the dripping water into the drain bowl C. The free end of the drain guides 35 and 36 have hook-shaped members 38 and 39 to mount the shampoo run-off attachment 34 on the shampoo drain bowl C.

I claim:

1. In combination, a portable children's auxiliary shampoo chair seated on a barber chair or the like, said portable children's auxiliary shampoo chair comprising:

(a) a seat;

(b) a back rest extending upwardly from said seat, said back rest comprising an arcuate neck rest formed at the top of said back rest to accommodate the back of the neck of a child;

(c) run-off attachment means comprising wing-like drain guides extending outwardly and downwardly from said neck rest, said run-off attachment means coacting with said neck rest to produce a saddle configuration to collect and guide liquid dripping from the head of a child into a drain receptacle; and (d) means interconnecting said seat and said back rest for pivotally moving said back rest relative to said seat.

2. A shampoo chair as claimed in claim 1 wherein said wing-like guides form an arcuate path in an outwardly and downwardly direction to lead the dripping liquid into the drain receptacle.

3. A shampoo chair as claimed in claim 2 wherein said wing-like guides are formed with hook-like members on the lower extremity thereof for gripping the drain receptacle.

* * * * *